United States Patent [19]

Johnson et al.

[11] 4,033,265

[45] July 5, 1977

[54] ANTI-COMPROMISE DEVICE

[75] Inventors: Clifford T. Johnson; Melvin J. McCubbin, both of Ridgecrest, Calif.

[73] Assignee: The United States of America as represented by the Secretary of the Navy, Washington, D.C.

[22] Filed: Mar. 25, 1976

[21] Appl. No.: 670,197

[52] U.S. Cl. ..... 102/56 SC

[51] Int. Cl.[2] ..... F42B 13/12

[58] Field of Search ..... 102/24 HC, 56 SC, 49.5

[56] References Cited

UNITED STATES PATENTS

| | | | |
|---|---|---|---|
| 2,426,997 | 9/1947 | Gray et al. | 102/56 SC |
| 2,706,949 | 4/1955 | Kessenich | 102/24 HC |
| 3,025,794 | 3/1962 | Lebourg et al. | 102/24 HC |
| 3,292,536 | 12/1966 | Church et al. | 102/24 HC |
| 3,974,771 | 8/1976 | Thomanek | 102/24 HC |

FOREIGN PATENTS OR APPLICATIONS

| | | | |
|---|---|---|---|
| 1,195,641 | 6/1965 | Germany | 102/24 HC |

*Primary Examiner*—Verlin R. Pendegrass
*Attorney, Agent, or Firm*—R. S. Sciascia; Roy Miller; Gerald F. Baker

[57] ABSTRACT

The forward bulkhead of a warhead casing centrally formed with a cylindrical indention which causes a forward jet when the warhead is detonated.

2 Claims, 1 Drawing Figure

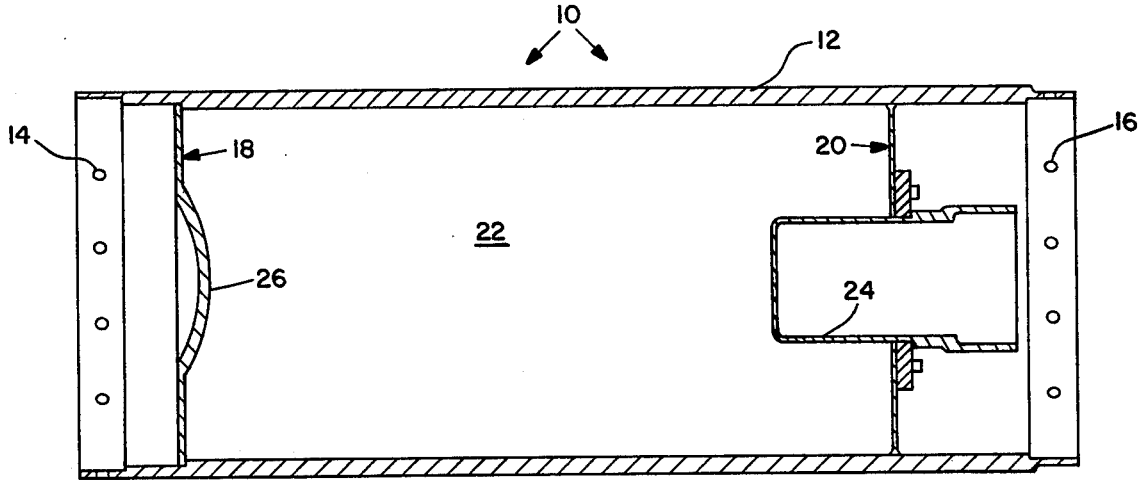
10
12
14
18
20
16
22
26
24

ANTI-COMPROMISE DEVICE

BACKGROUND OF THE INVENTION

The present invention relates to a method and apparatus for assuring that the guidance and control mechanism of a warhead carrying missile does not survive the detonation of the warhead.

More particularly the present invention relates to an anti-compromise device which is an integral part of the forward bulkhead of a warhead. Anti-compromise devices similar to that disclosed have been used in warheads but were formed of inserts or attachments to the forward bulkhead. Such prior anti-compromise devices were relatively expensive, of marginal size and suceptible to inexact installation. Furthermore, installation was awkward and the assembly was subject to explosive leakage.

SUMMARY OF THE INVENTION

According to the present invention, the forward bulkhead of a warhead is formed with a central bulge by a process which does not cause hardening of the metal. Because of the shape and character of the metal in the bulkhead, when the warhead is exploded the detonation shock front will cause hydrodynamic fluid flow of the bulkhead metal. Under these circumstances, the metal on the side opposite the explosive is fluid and flows toward a central juncture and forms a jet at this point. This jet of metal passes forward through the guidance and control section of the missile carrying the warhead to insure that the guidance mechanism is effectively destroyed.

BRIEF DESCRIPTION OF THE DRAWING

The single FIGURE of the drawing is a longitudinal corss sectional view of the warhead section of a missile embodying the present invention.

DESCRIPTION AND OPERATION

The warhead section generally indicated at 10 on the drawing comprises a casing 12 which is provided fore and aft respectively with means 14, 16, to attach the warhead section to a delivery missile. The warhead section is closed fore and aft by respective bulkheads 18 and 20 to form with the casing 12 a closed chamber 22 to contain the high explosive material of the warhead. The rear bulkhead 20 usually carries a booster cup 24, as shown, which typicaly carries a booster, detonater and fuse mechanism (not shown). A warhead of this type, therefore, is designed to be detonated from the aft end.

The forward bulkhead 18 according to the present invention has integral therewith a thickened arcuate concave portion 26 which is designed to act in a manner producing a forward Munroe effect (i.e., to produce a fluid metal jet) when the high explosive is detonated.

In missiles of the type for which this particular warhead is designed, the guidance and control unit (GCU) is attached as by fastening means generally indicated at 14 and lies forward between bulkhead 18 and the nose of the missile. The metal jet flowing forward because of the collapse of portion 26 of bulkhead 18 will, therefore, pass through and effectively destroy the GCU so that the design and operation of the GCU will not be exposed to the enemy when the warhead is detonated in enemy territory.

The bulkhead 18, including the central portion 26, is advantageously fabricated by pressing or machining wherein the metal is not hardened. For maximum Munroe effect, the metal should be fairly ductile so that an operation range of 100-400 kilobars of detonation shock front will cause hydrodynamic fluid flow. When the explosive is detonated, the metal on the side opposite the explosive chamber 22 will flow forward and toward a central point and form a high velocity forward moving jet at the collision juncture forward of bulkhead 18 along the central line of the warhead.

As indicated above, the total bulkhead 18 may be fabricated from solid bar stock of any malleable material. Alternatively, however, the dome portion may be fabricated from malleable material and welded to the sheet metal web.

Regardless of construction, it is contemplated that the bulkhead be fabricated in a one-piece design to minimize expense and facilitate accurate installation.

What is claimed is:

1. In a warhead section for a guided missile or the like the combination comprising:

a substantially cylindrical casing;

forward and aft bulkheads fastened within said casing and forming therebetween a chamber for containing a high explosive material;

said rear bulkhead having means associated therewith for detonating said explosive material; and said forward bulkhead including a planar peripheral portion and means associated therewith so constructed as to form a forward jet of molten metal when said explosive is detonated;

said last mentioned means including a centrally located spherical contoured portion of malleable ferrous metal bulging inwardly with respect to said chamber and having a thickness greater than said planar peripheral portion.

2. In a guided missile or the like wherein a substantially cylindrical warhead casing section forms a part of the missile body between a forward guidance and control unit (GCU) and an aft motor, the warhead section comprises an aft bulkhead with an associated detonation mechanism and a forward bulkhead incorporating an anticompromise mechanism for destruction of the GCU when the warhead is detonated;

the improvement comprising:

said forward bulkhead being integrally formed of a peripheral flat portion of finite thickness orthogonal to the axis of symmetry of said cylindrical warhead section and a relatively thicker central portion formed of a malleable metal in an arcuate contour convex with respect to the area between said bulkheads.

* * * * *